US006037108A

United States Patent [19]

Chen et al.

[11] Patent Number: 6,037,108

[45] Date of Patent: Mar. 14, 2000

[54] THERMALLY STABLE SUBBING LAYER FOR IMAGING ELEMENTS

[75] Inventors: Janglin Chen, Rochester; Richard A. Castle, Webster; Yongcai Wang, Penfield, all of N.Y.

[73] Assignee: Eastman Kodak Company, Rochester, N.Y.

[21] Appl. No.: 09/067,306

[22] Filed: Apr. 27, 1998

[51] Int. Cl.[7] ..... G03C 1/74; G03C 1/795; G03C 1/81

[52] U.S. Cl. ..... 430/349; 430/60; 430/533; 430/534; 430/539; 430/637; 430/638; 430/930; 430/935; 430/954; 427/384; 427/393.5; 428/480; 428/483

[58] Field of Search ..... 430/533, 534, 430/539, 637, 638, 954, 349, 60, 930, 935; 428/480, 483; 427/390.5, 384

[56] References Cited

U.S. PATENT DOCUMENTS

| | | | |
|---|---|---|---|
| 2,627,088 | 2/1953 | Alles et al. | 430/540 |
| 2,698,240 | 12/1954 | Alles et al. | 430/535 |
| 2,943,937 | 7/1960 | Nadeau et al. | 430/535 |
| 3,143,421 | 8/1964 | Nadeau et al. | 430/535 |
| 3,201,249 | 8/1965 | Pierce et al. | 430/514 |
| 3,271,178 | 9/1966 | Nadeau et al. | 430/535 |
| 3,443,950 | 5/1969 | Rawlins, Jr. . | |
| 3,501,301 | 3/1970 | Nadeau et al. | 430/535 |
| 3,988,157 | 10/1976 | Van Paesschen et al. | 430/539 |
| 4,001,023 | 1/1977 | Van Paesschen et al. | 430/539 |
| 4,141,735 | 2/1979 | Schrader et al. | 206/411 |
| 4,235,959 | 11/1980 | Thijs et al. | 430/531 |
| 4,407,939 | 10/1983 | Naoi et al. | 430/536 |
| 4,542,093 | 9/1985 | Suzuki et al. | 430/531 |
| 5,326,689 | 7/1994 | Murayama | 430/533 |
| 5,610,001 | 3/1997 | Mostaert et al. | 430/533 |
| 5,719,015 | 2/1998 | Mihayashi et al. | 430/533 |
| 5,895,744 | 4/1999 | Chen et al. | 430/533 |

*Primary Examiner*—Richard L. Schilling
*Attorney, Agent, or Firm*—Andrew J. Anderson

[57] ABSTRACT

A support for an imaging element is described, which support comprises a polyester polymeric film having coated thereon a subbing layer comprising gelatin and a multi-hydric organic compound having at least three hydroxyl groups, which gelatin subbing layer coated support has been subjected to a heat treatment to reduce the core-set curling tendency of the polymeric film. Imaging elements for use in an image-forming process is also described, which elements comprise a gelatin subbing layer coated polyester polymeric film support as described above, and an image-forming layer coated on the subbed support. A method for forming a heat-tempered, gelatin-subbed support for an imaging element is also described, comprising coating a subbing layer comprising gelatin and a multi-hydric organic compound having at least three hydroxyl groups on a polyester polymeric film, and subjected the coated film to heat treatment to reduce the core-set curling tendency of the polymeric film. In accordance with preferred embodiment of the invention, the polymer film comprises poly(ethylene naphthalate), the multi-hydric organic compound comprises glycerol, sorbitol, or pentaerythritol, and the heat treatment comprises subjecting the gelatin subbing layer coated support to a temperature of from 50° C. up to the glass transition temperature of the polymeric film for from 0.1 to 1500 hours.

19 Claims, No Drawings

THERMALLY STABLE SUBBING LAYER FOR IMAGING ELEMENTS

FIELD OF THE INVENTION

This invention relates in general to supports for imaging elements, such as photographic, electrostatophotographic and thermal imaging elements, and in particular to supports comprising a polyester polymeric film and a gelatin-based subbing layer, and imaging elements comprising such subbed polymeric film and an image-forming layer. More particularly, this invention relates towards such supports and imaging elements wherein the subbing layer is present on the support during a heat treatment period.

BACKGROUND OF THE INVENTION

Imaging elements are generally complicated systems comprising a support, adhesion or tie layers, image recording layers and auxiliary layers. The multiple layers required to achieve the desired performance results in a complicated coating process with severe requirements for adhesion to the support and between layers. U.S. Pat. No. 2,627,088, e.g., describes manufacturing process and general difficulty in adhesion to poly(ethylene terephthalate) film base.

Adhesion of the imaging and auxiliary layers to a polymer film support has traditionally been achieved through the use of suitable adhesion or tie layers referred to as a subbing system. Such a subbing system generally involves chemical treatment of the polymer surface with an etch or "bite" agent to improve adhesion of a tie layer. Alternatively, it is also known to subject the support to some form of "energetic" treatment prior to coating. Examples of energetic treatments include glowdischarge treatment (GDT or plasma treatment, coronadischarge treatment (CDT), ultraviolet radiation (UV) treatment, electron-beam treatment, and flame treatment. Subsequently, a polymeric tie layer is coated which has good adhesion to the chemically treated surface and to which subsequently applied layers have good adhesion. Some useful compositions for this purpose include polymers containing vinylidene chloride such as vinylidene chloride/methyl acrylate/itaconic acid terpolymers or vinylidene chloride/acrylonltrile/acrylic acid and the like; butadiene-based copolymers, glycidyl acrylate, or methacrylate containing copolymers, or maleic anhydride containing copolymers. These and other suitable compositions are described, for example, in U.S. Pat. Nos. 2,627,088; 2,698,240; 2,943,937; 3,143,421; 3,201,249; 3,271,178; 3,443,950; and 3,501,301. The polymeric subbing layer is in many instances overcoated with an additional subbing layer comprised of gelatin, typically referred to as a gel sub, or a single mixed subbing layer including polymer and gelatin may be used. The gel sub layer provides good adhesion to subsequently coated layers comprising hydrophilic colloid binders.

U.S. Pat. No. 4,141,735 describes a method for heat tempering or annealing a polyester film base roll, at elevated temperatures up to the glass transition temperature of the polyester, to reduce the core-set curling tendency of the film base material. Reduction in core-set curling tendency has become particularly important in connection with supports for films designed for use with the recently introduced Advanced Photo System™, which employs relatively small film cartridges.

As disclosed in U.S. Pat. No. 4,141,735, the film base may or may not be coated with one or more adhesion-promoting subbing layers prior to heat treatment to reduce core-set curling tendency. For improved manufacturing efficiencies, it frequently may be desirable to coat the polymer film with subbing layers prior to heat treatment to reduce core-set curling tendencies, especially where such subbing layers may be applied as part of the support manufacturing process itself. In such an in-line subbing process, the polymer support resin may be first melted and extruded onto a highly polished, smooth casting wheel surface and, before the base is stretched and tentered, a polymer subbing layer undercoat or tie layer may be applied onto one of the two surfaces. After drafting and tentering, a gelatin sub may then be coated over the under-coat, dried, and passed through a heating zone for 2 to 3 minutes to be "heat relaxed" for improvement of the film base's dimensional stability. The subbed film base, after being wound in a tight roll, may then be annealed in an oven to reduce the core-set curling tendencies of the flim Extended heat-treatment or annealing processes to reduce core-set curling tendencies of gelatin subbed films have been found to severely compromise the adhesive property of the gelatin sub to subsequently coated hydrophilic colloid layers, such as silver halide emulsion layers of silver halide photographic elements. It would be desirable to provide a gelatin subbed film support which may be subjected to heat-treatment or annealing for extended periods of time in a rolled form while maintaining adequate adhesion performance of the gelatin subbing layer to subsequently coated imaging element layers.

U.S. Pat. No. 4,235,959 discloses the use of sorbitol and hexanetriol compounds in subbing layers. U.S. Pat. No. 4,407,939 describes subbing layers for photographic polyester film base, comprised of a first subbing layer of a latex styrene-butadiene copolymer, and a second subbing layer containing gelatin derivatives prepared by reacting gelatin to increase the number of carboxylic groups in gelatin. U.S. Pat. No. 4,542,093 describes subbing layers for photographic polyester film base, comprised of a first subbing layer formed of a polymeric compound, and a second subbing layer containing gelatin and water-soluble methyl cellulose or polyvinyl alcohol. U.S. Pat. No. 5,326,689 describes a general description of producing a film base material which exhibits little core-set curl (via heat treatment) and good adhesive properties (via glow discharge surface treatment). U.S. Pat. No. 5,610,001 discloses gel subbing layers with 1,2,6-hexanetriol. None of the above art, however, discloses heat-treated polymer supports comprising gelatin based subbing layers in accordance with the instant invention, wherein we describe materials that can be added to the gel sub formulation to improve the sub's adhesive property after annealing.

SUMMARY OF THE INVENTION

In accordance with one embodiment of the invention a support for an imaging element is described, which support comprises a polyester polymeric film having coated thereon a subbing layer comprising gelatin and a multi-hydric organic compound having at least three hydroxyl groups, which gelatin subbing layer coated support has been subjected to a heat treatment to reduce the core-set curling tendency of the polymeric film.

In accordance with a further embodiment of the invention, an imaging element for use in an image-forming process is described, which element comprises a gelatin subbing layer coated polyester polymeric film support as described above, and an image-forming layer coated on the subbed support In accordance with another embodiment of the invention, a method for forming a heat-tempered, gelatin-subbed support for an imaging element is described, comprising coating a subbing layer comprising gelatin and a multi-hydric organic compound having at least three hydroxyl groups on a polyester polymeric film, and subjected the coated film to heat treatment to reduce the core-set curling tendency of the polymeric film.

In accordance with preferred embodiment of the invention, the polymer film comprises poly(ethylene naphthalate), the multi-hydric organic compound comprises glycerol, sorbitol, or pentaerythritol, and the heat treatment comprises subjecting the gelatin subbing layer coated support to a temperature of from 50° C. up to the glass transition temperature of the polymeric film for from 0.1 to 1500 hours.

DETAILED DESCRIPTION OF THE INVENTION

Polyester film supports which are useful for the present invention include polyester supports such as, poly(ethylene terephthalate), poly(1,4-cyclohexanedimethylene terephthalate), poly(ethylene 1,2-diphenoxyethane-4,4'-dicarboxylate), poly(butylene terephthalate), and poly (ethylene naphthalate) and the like; and blends or laminates thereof with other polymers. Particularly preferred embodiments are poly(ethylene terephthalate) and poly(ethylene naphthalate), and poly(ethylene naphthalate) is especially preferred for use as the support for photographic imaging elements designed for use in the Advanced Photo System™. Preferred polymer film support thickness is less than 400 microns, more preferably less than 200 microns and most preferably less than 150 microns. Practical minimum support thickness is about 50 microns. The supports can either be colorless or colored by the addition of a dye or pigment The use of heat processes during conventional polymer film manufacture to modify the physical characteristics of polymer film elements is itself well known. For example, in the continuous manufacture of certain thermoplastic film, particularly polyester film by processes involving extrusion from bulk storage of polymer stock material, it is necessary in order to obtain desired physical properties, such as transparancy, tensile strength and dimensional stability, that the usually amorphous, extruded body of film subsequently be heated and worked by prescribed treatments. In such heating and working treatments, the heated film usually is first stretched lengthwise about 2 to 4 times its original length, and then similarly stretched widthwise. The stretching, known as "cold drawing", is carried out at temperatures below the temperature of melting but above the glass transition temperature of the polymer. The resulting film is then described as being biaxially-oriented. The cold drawing affects some change in the crystallinity of the polymer. Next, to enhance the crystallinity and to increase the dimensional stability of the film, the biaxially-oriented polymeric film is "heat-sef" by heating it near its crystallization point, while maintaining it under tension. The heating and tensioning also ensure that the heat-set film remains transparent upon cooling. After being directionally oriented and heat-set polymer films are then also conventionally subjected to a subsequent heat treatment known in the art as a "heat-relax" treatment or step at approximately the "creep temperature" of the particular polymer, which is located in a range above the glass transition temperature but below the range at which the heat-setting step is carried out. The heat-relax treatment is conventionally followed by a cooling treatment to below the glass transition temperature, at which point the film is in condition suitable for further handling, including winding of the film into rolls on conveniently sized storage tubes or "cores".

Gelatin subbed supports in accordance with the invention are subjected to an extended heat tempering or annealing step after conventional support film manufacturing heat treatment to reduce the core-set curling tendencies of the support. Such "post manufacture" heat tempering or annealing step may comprise heating the gelatin subbed film support at a temperature in the range from about 30° C. (more preferably from about 50° C.) up to about the glass transition temperature (Tg) of the support polymer for from 0.1 to 1500 hours (more preferably 0.25 to 500 hours) substantially as described in U.S. Pat. No. 4,141,735 or U.S. Pat. No. 5,326,689, or alternatively the "slow cooling" post heat treatment from not less than Tg to less than Tg as described in U.S. Pat. No. 5,326,689. The disclosures of U.S. Pat. Nos. 4,141,735 and 5,326,689 are incorporated by reference herein in their entirety. The heat tempering or annealing step for reducing core-set curling tendencies may be distinguished from typical support manufacturing heat treatment in that it is usually performed after the support is wound on a roll rather than as part of the primary support manufacturing process, although this is not an absolute requirement The polymer film supports of the invention are coated with a gelatin based subbing layer prior to heat tempering or annealing to reduce core-set curling tendencies of the support The gelatin subbing layer may be coated directly on the polymer film support, or may be coated over a polymeric undercoat or tie layer as is well known in the art The gelatin in the subbing layer in accordance with this invention includes any type of gelatin such as acid processed gelatin or lime processed gelatin. Acid processed, deionized gelatin is preferred for use in the subbing layers of this invention. A hardening agent such as chrome alum and matte particles such as poly(methylmethacrylate) beads may be used if desired. To improve coatability, a surfactant, such as Olin 10G, Saponin or Alkanol-XC, may be used. It should also be noted that the invention applies to suitable polymer supports with treatments and/or coatings applied to the side opposite that which is to be coated with a gel sub layer in accordance with the present invention.

In accordance with the invention, the gelatin based subbing layer comprises an additive which improves the adhesion of subsequently coated imaging element layers to the gelatin subbing layer. The additive materials of this invention are multi-hydric organic compounds with at least three hydroxyl groups in the chemical structure. Examples of such compounds include Glycerol ($HOCH_2CHOHCH_2OH$), Sorbitol ($HOCH_2(CHOH)_4CH_2OH$), Pentaerythritol ($C(CH_2OH)_4$), and polymers comprising multiple hydroxyl groups such as poly(vinyl alcohol). In preferred embodiments, the multi-hydric organic compound is a non-polymeric compound (e.g., molecular weight less than 1000, more preferably less than 500), as higher levels of polymeric compounds may be required to give consistently effective results, which may add significantly to the subbing layer thickness. The multi-hydric organic compound may be added at any effective level to the subbing layer composition, but is preferably added at less than or equal to the weight amount of gelatin in the subbing layer, more preferably less than or equal to 60 wt % of the amount of gelatin. Particularly preferred amounts of multi-hydric organic compound is from about 10 to 60 wt % of the amount of gelatin. Typically, the dry coating weight of the gelatin based sub layer is about 10 to 1000 mg/m$^2$, more preferably about 50 to 250 mg/m$^2$, and the subbing layer thickness typically ranges from about 0.01 to 1.0 micron, more preferably about 0.05 to 0.25 micron.

The gel sub coated supports of this invention can be used for many different types of imaging elements. While the invention is applicable to a variety of imaging elements such as, for example, photographic, electrostatophotographic, photothermographic, migration, electrothermographic, dielectric recording and thermal-dye-transfer imaging elements, the invention is primarily applicable to photographic elements, particularly silver halide photographic elements. Accordingly, for the purpose of describing this invention and for simplicity of expression, photographic elements will be primarily referred to throughout this specification; however, it is to be understood that the invention also applies to other forms of imaging elements.

Photographic elements which can be provided with a subbing layer in accordance with the invention can differ widely in structure and composition. For example, they can vary greatly in the type of support, the number and composition of image-forming layers, and the kinds of auxiliary layers that are included in the elements. In particular, the photographic elements can be still films, motion picture films, x-ray films, graphic arts films, prints, or microfiche. They can be black-and-white elements or color elements. They may be adapted for use in a negative-positive process or for use in a reversal process.

The supports of the present invention may optionally be coated with a wide variety of additional functional or auxiliary layers such as antistatic layers, abrasion resistant layers, curl control layers, transport control layers, lubricant layers, image recording layers, additional adhesion promoting layers, layers to control water or solvent permeability, and transparent magnetic recording layers. In a preferred embodiment of the invention, the backside of the support (opposite side to which image forming emulsion layers are coated) is coated with an antistatic layer, a transparent magnetic recording layer and an optional lubricant layer. A permeability control layer may also be preferably coated between the antistatic layer and transparent magnetic recording layer. Magnetic layers suitable for use in elements in accordance with the invention include those as described, e.g., in *Research Disclosure*, November 1992, Item 34390. Representative antistatic layers, magnetic recording layers, and lubricant layers are described in U.S. Pat. No. 5,726,001, the disclosure of which is incorporated herein by reference. It is also specifically contemplated to use supports according to the invention in combination with technology useful in small format film as described in *Research Disclosure*, June 1994, Item 36230. *Research Disclosure* is published by Kenneth Mason Publications, Ltd., Dudley House, 12 North Street, Emsworth, Hampshire P010 7DQ, ENGLAND.

The image-forming layer for imaging elements comprising a gel-subbed support in accordance with the invention is preferably coated over the gel sub layer. In preferred embodiments of the invention, the imaging element comprises a photographic element, and the image forming layer comprises a silver halide emulsion layer.

Photographic elements in accordance with the preferred embodiment of the invention can be single color elements or multicolor elements. Multicolor elements contain image dye-fomling units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, antihalation layers, overcoat layers, additional subbing layers, and the like.

In the following discussion of suitable materials for use in the photographic emulsions and elements that can be used in conjunction with the subbed supports of the invention, reference will be made to *Research Disclosure*, September 1994, Item 36544, available as described above, which will be identified hereafter by the term "*Research Disclosure*." The Sections hereafter referred to are Sections of the *Research Disclosure*, Item 36544.

The silver halide emulsions employed in the image-forming layers of photographic elements can be either negative-working or positive-working. Suitable emulsions and their preparation as well as methods of chemical and spectral sensitization are described in Sections I, and III–IV. Vehicles and vehicle related addenda are described in Section II. Dye image formers and modifiers are described in Section X. Various additives such as UV dyes, brighteners, luminescent dyes, antifoggants, stabilizers, light absorbing and scattering materials, coating aids, plasticizers, lubricants, antistats and matting agents are described, for example, in Sections VI–IX. Layers and layer arrangements, color negative and color positive features, scan facilitating features, supports, exposure and processing can be found in Sections XI–XX.

In addition to silver halide emulsion image-forming layers, the image-forming layer of imaging elements in accordance wvith the invention may comprise, e.g., any of the other image forming layers described in Christian et al. U.S. Pat. No. 5,457,013, the disclosure of which is incorporated by reference herein.

The following examples will illustrate the advantages of adding the materials of this invention to the conventional gelatin sub formulation.

Ex. 1

(a) Preparation of the Subbed Support

A 90 micron thick, biaxially oriented poly(ethylene naphthalate) film base (Tg=119° C.) is provided, on one of the surfaces, a 0.1 micron thick subbing layer of a copolymer of acrylonitrile, vinylidene chloride and acrylic acid (monomer weight ratio 15:78:7). Over the polymer subbing layer, a second subbing solution of the following composition (referred to as GS-1, hereafter), is coated at 10 ml/m$^2$, and dried for 2 minutes at 110° C. to a thickness about 0.1 micron.

| GS-1: | |
|---|---|
| Acid processed, deionized pig skin gelatin | 1 part by weight |
| Coating surfactant, saponin | 0.01 part by weight |
| Poly(methyl methacrylate) matte beads | 0.015 part by weight |
| Distilled water | 99 parts by weight |

(b) Heat Treatment (annealing) of the Subbed Support

The coated support from above, was wrapped around a fiber glass core of 13 cm in diameter, and annealed in a heat oven for 5 days at 100° C.

Coating of Backing Layers

The annealed support was subsequently coated on the other surface with bacldng layers, which include an antistatic undercoat, a magnetic oxide recording layer and a lubricating overcoat, similarly as described in Example 1b of U.S. Pat. No. 5,709,984, with methanol being used in place of ethanol in the antistatic undercoat layer coating formulation.

Coating of Light Sensitive Layers

Layers of a conventional color photographic emulsion were coated to the subbing layer of the support, as described in the Example 1 of U.S. Pat No. 5,639,589.

Ex. 2

Like Ex. 1, except that the subbed support was not annealed.

Ex. 3 to 11

Like Ex. 1, except that the following materials were added, respectively, to the gelatin sub composition, GS-1:

Ex. 3—0.20 part by weight of glycerol added to the sub composition GS-1

Ex. 4—0.60 part by weight of glycerol was added to GS-1

Ex. 5—0.15 part by weight of pentaerythritol was added to GS-1

Ex. 6—0.20 part by weight of pentaerythritol was added to GS-1

Ex. 7—0.30 part by weight of pentaecythritol was added to GS-1

Ex. 8—0.20 part by weight of sorbitol was added to GS-1

Ex. 9—0.30 part by weight of sorbitol was added to GS-1

Ex. 10—0.30 part by weight of 1,4-butanediol was added to GS-1

Ex. 11—0.30 part by weight of 1,3-butanediol was added to GS-1

Wet Adhesion Test

A 35 mm×12.7 cm strip of the coating is soaked at 37.8° C. for 3 minutes and 15 seconds in the Kodak Flexicolor Developer replenisher solution. The strip is then scored with a pointed stylus tip across the width of the strip, and placed in a test cell filled with a developer solution. A weighted (900 gram), filled natural rubber pad, 3.49 cm in diameter, is then placed over of the strip, and rubbed across the scored line back and forth for 100 times. After the test, the film strip is examined for any emulsion removal beyond the scored line:

| Test Sample | Emulsion Removal |
|---|---|
| Ex. 1 Control | Yes |
| Ex. 2 Unannealed control | No |
| Ex. 3 Invention | No |
| Ex. 4 Invention | No |
| Ex. 5 Invention | No |
| Ex. 6 Invention | No |
| Ex. 7 Invention | No |
| Ex. 8 Invention | No |
| Ex. 9 Invention | No |
| Ex. 10 Comparison | Yes |
| Ex. 11 Comparison | Yes |

From the adhesion test results, it is therefore concluded that the heat treatment process compromises the wet adhesion property of the gelatin sub layer (Ex. 2 vs. Ex. 1), and the adhesion property of gel sub is improved by the addition of a multi-hydric organic compound material in accordance with the invention to the gelatin sub composition (Ex. 3 to 9 vs. Ex. 1). The adhesion benefit is not observed with organic compounds with less than three hydroxyl groups in the structure (Ex. 10 and 11).

We claim:

1. A support for an imaging element, comprising a polyester polymeric film having coated thereon a subbing layer comprising gelatin and a multi-hydric non-polymeric organic compound having at least three hydroxyl groups selected from sorbitol and pentaerythritol, which gelatin subbing layer coated support has been subjected to a heat treatment to reduce the core-set curling tendency of the polymeric film, wherein the heat treatment comprises subjecting the gelatin subbing layer coated support to a temperature of from 30° C. up to the glass transition temperature of the polymeric film for at least 0.1 hour.

2. A support according to claim 1, wherein the gelatin subbing layer coated support is in roll form when subjected to the heat treatment.

3. A support according to claim 1, wherein the heat treatment comprises subjecting the gelatin subbing layer coated support to a temperature of from 50° C. up to the glass transition temperature of the polymeric film for from 0.1 to 1500 hours.

4. A support according to claim 1, wherein the multihydric organic compound is present in the gelatin subbing layer at less than or equal to 60 wt % to of the amount of gelatin.

5. A support according to claim 1, wherein the multihydric organic compound is present in the gelatin subbing layer at from 10 to 60 wt % of the amount of gelatin.

6. A support according to claim 1, wherein the thickness of the gelatin subbing layer is from about 0.05 to 0.25 micron.

7. A support according to claim 1, wherein the polymer film comprises poly(ethylene naphthalate).

8. A support according to claim 7, wherein the heat treatment comprises subjecting the gelatin subbing layer coated support to a temperature of from 50° C. up to the glass transition temperature of the polymeric film for from 0.1 to 1500 hours.

9. A support according to claim 7, wherein the multihydric organic compound is present in the gelatin subbing layer at from 10 to 60 wt % of the amount of gelatin.

10. An imaging element for use in an image-forming process, comprising a gelatin subbing layer coated polyester polymeric film support according to claim 1, and an image-forming layer coated on the subbed support.

11. An imaging element according to claim 10, wherein the polymeric film comprises poly(ethylene naphthalate).

12. An imaging element according to claim 10 in which the image forming layer comprises silver halide grains dispersed in gelatin.

13. A method for forming a heat-tempered, gelatin-subbed support for an imaging element, comprising coating a subbing layer comprising gelatin and a non-polymeric multihydric organic compound having at least three hydroxyl groups selected from glycerol, sorbitol, and pentaerythritol on a polyester polymeric film, and subjecting the coated film to heat treatment to reduce the core-set curling tendency of the polymeric film, wherein the heat treatment comprises subjecting the gelatin subbing layer coated support to a temperature of from 30° C. up to the glass transition temperature of the polymeric film for at least 0.1 hour.

14. A method according to claim 12, wherein the polymer film comprises poly(ethylene naphthalate).

15. A method according to claim 14, wherein the heat treatment comprises subjecting the gelatin subbing layer coated support to a temperature of from 50° C. up to the glass transition temperature of the polymeric film for from 0.1 to 1500 hours.

16. A method according to claim 15, wherein the gelatin subbing layer coated support is in roll form when subjected to the heat treatment.

17. A method according to claim 13, wherein the gelatin subbing layer coated support is in roll form when subjected to the heat treatment.

18. A support according to claim 1, wherein the multihydric organic compound comprises pentaerythritol.

19. A method according to claim 13, wherein the multihydric organic compound comprises pentaerythritol.

* * * * *

UNITED STATES PATENT AND TRADEMARK OFFICE

CERTIFICATE OF CORRECTION

PATENT NO. : 6,037,108
DATED : March 14, 2000
INVENTOR(S) : Janglin Chen et al.

It is certified that error appears in the above-identified patent and that said Letters Patent is hereby corrected as shown below:

Claim 13,
-- A method for forming a heat-tempered, gelatin-subbed support for an imaging element, comprising coating a subbing layer comprising gelatin and a non-polymeric multi-hydric organic compound having at least three hydroxyl groups selected from sorbitol and pentaerythritol on a polyester polymeric film, and subjecting the coated film to heat treatment to reduce the core-set curling tendency of the polymeric film, wherein the heat treatment comprises subjecting the gelatin subbing layer coated support to a temperature of from 30°C up to the glass transition temperature of the polymeric film for at least 0.1 hour. --

Claim 14,
-- A method according to claim 13 wherein the polymer film comprises poly(ethylene naphthalate). --

Signed and Sealed this

Twenty-ninth Day of January, 2002

*Attest:*

*Attesting Officer*

JAMES E. ROGAN
*Director of the United States Patent and Trademark Office*